US006202939B1

(12) United States Patent
Delcea

(10) Patent No.: US 6,202,939 B1
(45) Date of Patent: Mar. 20, 2001

(54) SEQUENTIAL FEEDBACK INJECTOR FOR THERMAL SPRAY TORCHES

(76) Inventor: Lucian Bogdan Delcea, 2078 Shaughnessy Street, Port Coquitlam, British Columbia (CA), V3C 3C5

( * ) Notice: Subject to any disclaimer, the term of this patent is extended or adjusted under 35 U.S.C. 154(b) by 0 days.

(21) Appl. No.: 09/437,341

(22) Filed: Nov. 10, 1999

(51) Int. Cl.[7] ..... B05B 1/24
(52) U.S. Cl. ..... 239/79; 239/424; 239/DIG. 7
(58) Field of Search ..... 239/79, 80, 81, 239/548, 132.3, 419, 423, 424, DIG. 7; 219/121.47, 121.5, 76.15, 76.16

(56) References Cited

U.S. PATENT DOCUMENTS

| | | |
|---|---|---|
| 3,140,380 | 7/1964 | Jensen . |
| 3,312,566 | 4/1967 | Winzeler et al. . |
| 4,416,421 | 11/1983 | Browning . |
| 4,540,121 | 9/1985 | Browning . |
| 4,780,591 | 10/1988 | Bernecki et al. . |
| 5,008,511 | 4/1991 | Ross . |
| 5,225,652 | 7/1993 | Landes . |
| 5,332,885 | 7/1994 | Landes . |
| 5,420,391 | 5/1995 | Delcea . |
| 5,556,558 | 9/1996 | Ross et al. . |
| 5,837,959 | 11/1998 | Muehlberger et al. . |

OTHER PUBLICATIONS

Future Power Systems Group, Current Research Projects, Coanda Effect, Internet page, 24–06–99.
National Advisory Committee For Aeronautics, Technical Note 4377, Washington, 1958, pp. 1–22–26.

*Primary Examiner*—Andres Kashnikow
*Assistant Examiner*—Lisa Ann Douglas
(74) *Attorney, Agent, or Firm*—Bull, Housser & Tupper

(57) ABSTRACT

A feedstock injector for connection to a plasmatron or to a fuel combustion chamber comprises a plurality of major channels arranged symmetrically about a core member, the channels leading from the upstream end of the injector towards a downstream region of convergence. In a preferred embodiment of the core member, a plurality of minor channels are provided, each minor channel leading from the inner wall of a major channel towards a minor region of convergence located inside the core. A feedstock-input passage is located axially inside the core, the passage communicating at its upstream end with the minor region of convergence and opening at its lower end through the tip of the core and a feedstock-supply passage opens into the side of the feedstock-input passage. In an alternate preferred embodiment of the core member, a minor channel extends axially from the upstream end to the downstream end of the core and feedstock-supply passage opens into the side of the minor channel.

12 Claims, 5 Drawing Sheets

SEQUENTIAL FEEDBACK INJECTOR FOR THERMAL SPRAY TORCHES

FIELD OF THE INVENTION

This invention relates to a feedstock injector for receiving a stream of heated gas, the injector used to inject the feedstock first into the flow of a minor portion of the stream and to subsequently inject the feedstock and the minor portion of the stream axially into the downstream flow of the major portion of the stream.

BACKGROUND OF THE INVENTION

Thermal spraying is a coating method wherein powder or other feedstock material is fed into a stream of heated gas produced by a plasmatron or by the combustion of fuel gasses. The feedstock is entrapped by the hot gas stream from which it is transferred heat and momentum and it is further impacted onto a surface where it adheres and solidifies, forming a relatively thick thermally sprayed coating by the cladding of subsequent thin layers or lamellae.

It has been recognized for some time that, in the case of some thermal spray applications, injecting feedstock axially into a heated gas stream presents certain advantages over traditional methods wherein feedstock is fed into the stream in a direction generally described as radial injection, in other words in a direction more or less perpendicular to the direction of travel of the stream. Such advantages of the axial injection relate mainly to the potential to control better the linearity and the direction of feedstock particle trajectory. It would be therefore desirable to inject feedstock in a manner that induces an optimal particle trajectory in the axial direction.

Plasma torches with axial injection of feedstock can be classified in two major groups: a) with multiple cathodes, also known as the pluri-plasmatron or the multiple-jet type; b) with single cathode, also known as the single stream type.

Examples of multiple cathode plasma torches with axial injection are found in U.S. Pat. No. 3,140,380 of Jensen, U.S. Pat. No. 3,312,566 of Winzeler et al., U.S. Pat. No. 5,008,511 of Ross and U.S. Pat. No. 5,556,558 of Ross et al. They show a plurality of plasmatrons symmetrically arranged about the axis of the plasma spray torch and provide for nozzle means to converge the plurality of plasmas into a single plasma stream. Feeding means are also provided to inject feedstock materials along the axis of the single plasma stream. Although such plasma torches can produce satisfactory coatings, they involve complex torch configurations as well as the use of multiple power supplies for the multiple cathodes. The use of multiple cathodes and multiple arc chambers, which need to be replaced regularly, induce high operating costs for such plasma torches. A different approach to achieve axial injection employing multiple cathodes and a complex single arc chamber configuration is found in U.S. Pat. Nos. 5,225,652 and 5,332,885, both issued to Landes.

The single cathode type plasma torches with axial injection have certain advantages such as a less complex torch configuration, less operating costs and less manufacturing costs for the plasma system. It has been recognized for some time that the introduction of powder axially through a central hole in the cathode tip is not an efficient solution for axial injection. Such an approach is found in U.S. Pat. No. 5,225,652 of Landes. The powder interferes with the electric arc, readily resulting in malfunctioning of the torch. Other arrangements for the single cathode approach are found in U.S. Pat. No. 4,540,121 of Browning, U.S. Pat. No. 4,780,591 of Bernecki et al., U.S. Pat. No. 5,420.391 of Delcea and U.S. Pat. No. 5,837,959 of Muehlberger et al. For example, Muehlberger et al. teach an output plasma nozzle oriented at an acute angle with respect to torch axis. A powder feed tube axial with the output nozzle opens at or about the bent in the plasma path or alternatively penetrates into the plasma stream. Both alternatives proposed by Muehlberger induce a non-uniform interaction between the plasma stream and the powder due to bending of the stream and the introduction of an angled tube in the path of the stream. The plasma stream has a lower density and velocity along the wall of the far side bent, which affects the trajectory of the powder. Bemecki et al. teach a semi-splitting of the plasma stream by means of an arm which protrudes radially into the plasma stream and connects to a core member positioned axially within the plasma torch nozzle. This approach creates an asymmetrical plasma stream at the point of powder injection, with a portion of the plasma stream going undisturbed about the injector, while the rest of the stream s split by the arm before the injection point. It is clear that if an additional arm was provided symmetrically in Bemecki, a symmetrical splitting and uniform interaction between the plasma stream and the powder would be achieved. This improvement is found in patent '391 of Delcea, which teaches a single step symmetrical splitting of a single plasma stream and the axial injection through the core member. One of the disadvantages common to the designs found in patents '591 and '391 is related to the short length of the feedstock input passage running axially inside the core. When using reasonable carrier gas flows, the carrier gas and the powder are bent at 90° and cannot be accelerated sufficiently along the short feedstock passage in order to be efficiently projected axially into the plasma stream without being affected by turbulence. If higher carrier gas flows are used to more efficiently push the powder axially, the injection of the carrier gas will cool the plasma to the detriment of torch efficiency. On the other hand, if the feedstock input passage is extended sufficiently, the elongated core becomes exposed excessively to the hot plasma, with deleterious effects on the core and on the thermal efficiency of the torch. Patent '121 of Browning discloses a single cathode plasma torch which splits the plasma stream in a first plurality of equal streams and then further splits each of the first plurality of streams in a second plurality of equal streams symmetrically arranged about the core. The second splitting occurs simultaneously with bending of the streams at 90 degrees. The bending of the streams allows for an extended core and an extended powder feed channel. This approach apparently could solve the problem of powder axial acceleration affecting the torches shown in Bernecki and Delcea. However, Browning's torch has a complicated and complex configuration, and the torch is highly inefficient due to multiple turbulent disruptions of the plasma stream induced by multiple cascade-splitting and bending of the stream.

With respect to combustion spray torches, in a majority of cases the powder is injected radially at the inlet of an elongated output nozzle. In one prior art, U.S. Pat. No. 4,416,421 of Browning, the powder is injected axially in a flame-spray apparatus extremely similar to the plasma torch described by same Browning in U.S. Pat. No. 4,540,121. Therefore, the feedstock injection method described by Browning in Patent '421 presents the same disadvantages as described above with reference to the Browning Patent '121.

In the case of all thermal spray torches, it is of notorious practice to attach an output spray nozzle in order to increase feedstock velocity and the transfer of heat to the feedstock. As a general rule, the longer the output nozzle the more velocity is transferred from the gas stream to the feedstock and therefore denser thermal spray coatings can be obtained. One of the main factors that limit the size of the output nozzle is the trajectory of the molten feedstock along the nozzle passage. If the injection of the feedstock is such that at least some feedstock deviates towards the internal wall of the nozzle, it will solidify and build up on the cold surface of the internal wall therefore resulting in malfunctioning of the spray process.

Accordingly, it would be desirable to provide a feedstock injector for attachment to a single stream spray torch, the injector providing for optimal interaction between the feedstock and the gas stream.

BRIEF SUMMARY OF THE INVENTION

The present invention provides a feedstock injector for attachment to a thermal spray torch, wherein the feedstock is injected first into the flow of a minor portion of the gas stream produced by the torch. The minor portion of the gas stream with the entrained feedstock is subsequently injected axially into the major portion of the gas stream.

The feedstock injector has a longitudinal axis and a core located axially in an interior region of the injector. The upstream end of the injector is shaped to receive a single stream of heated gas and to split the stream into a plurality of major streams, the streams arranged symmetrically about the longitudinal axis. A plurality of major channels are shaped symmetrically about the core and are oriented to converge the plurality of major streams from the upstream end of the injector towards a major region of convergence located axially downstream of the core. A feedstock-input passage is located axially inside the core. The feedstock-input passage is connected at its upstream end to the minor region of convergence and opens at its downstream end through the tip of the core towards the major region of convergence. At least one feedstock supply passage extends from outside of the injector into the core and opens into the side of the feedstock-input passage. Feedstock, distributed in a carrier gas, is supplied through the feedstock supply passage and is discharged into the feedstock-input passage. In a first embodiment of the core, a plurality of minor converging channels are provided symmetrically inside the core, each channel having its upstream end opening on the inner wall of a major channel. A minor part of the gas stream flowing through the major channels is captured by the minor channels and is further directed towards a minor region of convergence located inside the core, the minor region of convergence communicating with the feedstock input passage. The streams flowing through the minor channels merge into a single stream flowing forward along the feedstock input passage, the single stream entraps the feedstock and propels it in an axial direction along the feedstock-input passage. The feedstock is subsequently ejected axially through the tip of the core towards the major region of convergence and is further entrapped by the combined flow of the major streams.

In an alternate embodiment of the core, a minor channel is provided axially into the core, the channel extending from the upstream end of the core and opening through the tip of the core towards the major region of convergence. A minor portion of the stream inputting the injector is directed into the minor channel.

BRIEF DESCRIPTION OF THE DRAWINGS

Further features and advantages will be evident from the following detailed description of the preferred embodiments of the present invention and in conjunction with the accompanying drawings, in which.

DETAILED DESCRIPTION

Figure 1A:
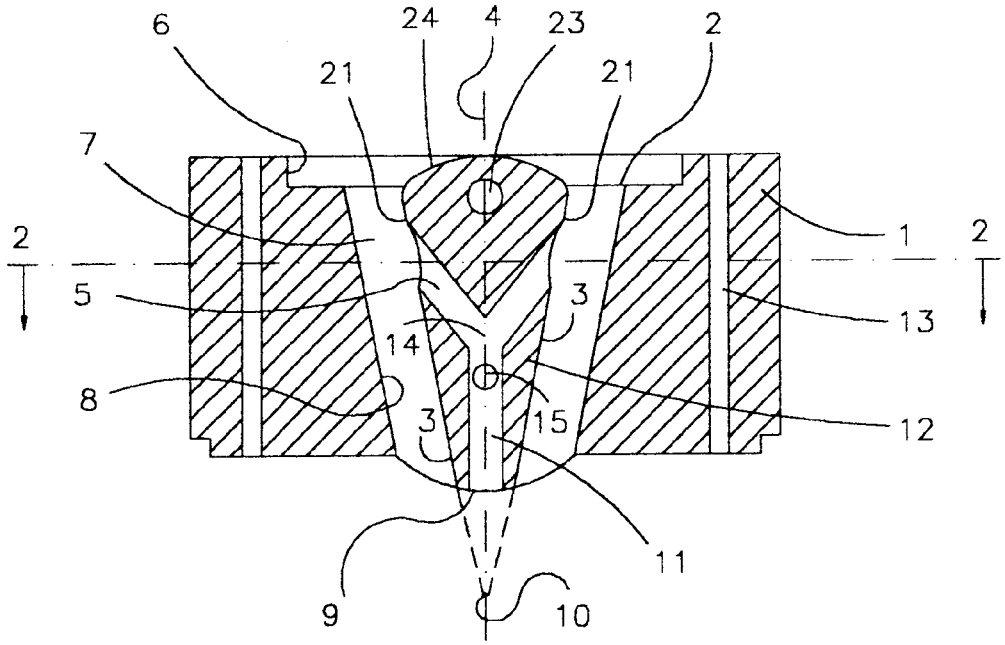
FIG. 1A is a schematic front elevation view of the feedstock injector of the present invention, in cross-section showing a first embodiment of the core comprising a plurality of minor channels and having the feedstock supply passage opening located downstream of the minor region of convergence of the minor channels.

Referring initially to FIG. 1A, FIG. 1B, FIG. 2 and FIG. 3 of the drawings, the feedstock injector is shown having a body 1 and a longitudinal axis 4. Passages 13 are provided in body 1 for passing a cooling agent. A suitable cavity 6 may be shaped at the upstream end of the injector in order to facilitate the connection to the output of a plasma generator such as a plasmatron or to a source of heated gas such as a fuel combustion chamber. A core 12 extends axially from the upstream end to the downstream end of the injector and ends with apex or tip 9. A plurality of major channels 7, are arranged symmetrically about axis 4, leading from the upstream end of body 1 towards a major region of convergence generally indicated at numeral 10, located on axis 4 downstream of core tip 9. Channels 7 are of essentially identical shape and substantially surround core 12. Each of channels 7 comprises outer and inner path defining surfaces or walls 8 and 3 respectively. The plurality of inner walls 3 substantially define core 12. Each pair of walls 8 and 3 are closed at each end by opposed channel walls 16 and 17. Each pair of adjacent channel walls 16 and 18 define an arm 19 extending radially from the outer walls 8 to the core 12. It is not essential that channels 7 always have a curved shape as illustrated in the drawings, they may have any other suitable shape e.g. oval or round.

Figure 2:
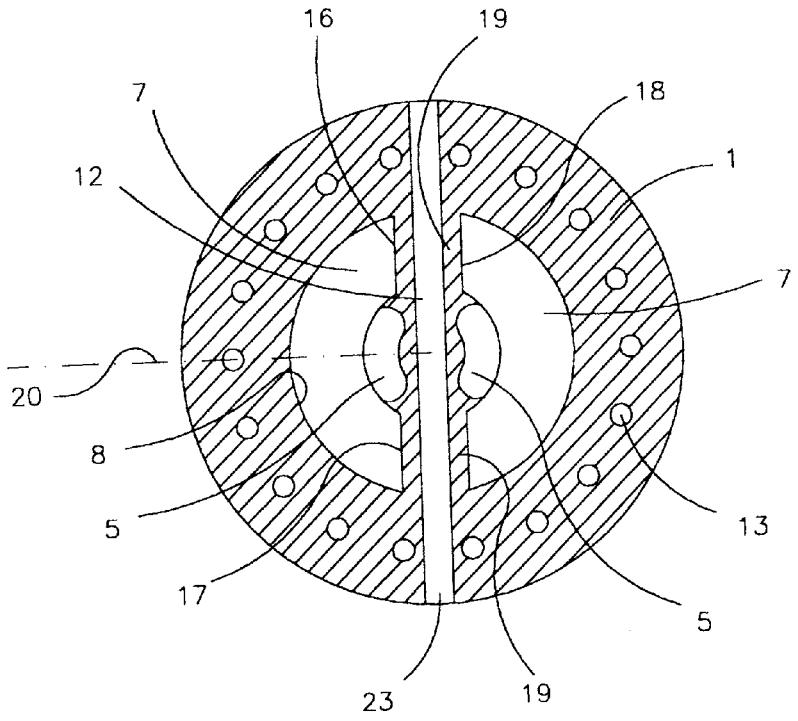
FIG. 2 is a plan view of a section taken along line 2—2 in FIG. 1.
Figure 3:
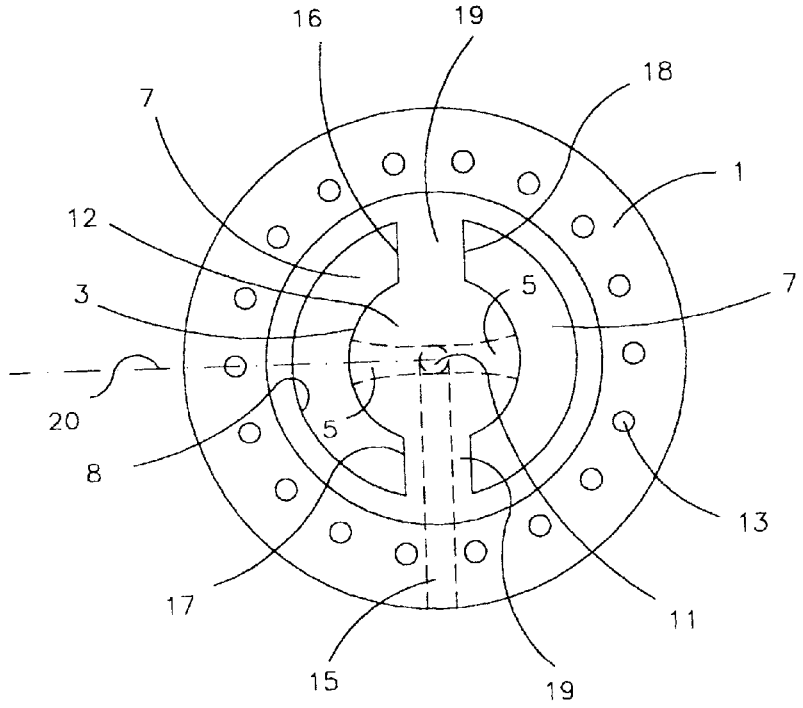
FIG. 3 is a plan view of the feedstock injector shown in FIG. 1.

In a first preferred embodiment, core 12 comprises a plurality of minor channels 5, symmetrically distributed about axis 4 and having a minor region of convergence 14 located inside core 12. Channels 5 are of essentially identical shape. The inlet end of each of channels 5 opens on the surface of the inner wall 3 of a major channel 7. The cross-section of minor channel 5 is shown in FIG. 2 as having a curved or kidney like shape. It is not essential that channels 5 always have a curved shape as illustrated in the drawings, they may have any other suitable shape e.g. oval or round. The main principle of fluid mechanics that determines a minor portion of the gas stream flowing through channel 7 to be deflected into channel 5 is the "Coanda effect". At its broadest level, the Coanda phenomenon can be explained as the deflection of streams by solid surfaces. It is well known that flows have a tendency to become attached to and therefore flow around a solid surface contacted by the flow. Accordingly, a portion of the stream flowing adjacent to the upstream portion 21 of inner wall 3 will be deflected into the minor channel 5. The ratio of the total cross-sectional area of the plurality of minor channels 5 and the total cross-sectional area of the plurality of major channels 7 is smaller than 1 and is preferably smaller than 1 to 20. The optimal ratio will be determined experimentally on a case by case basis, depending on the properties of the feedstock used. The cooling of the core is achieved by conducting heat through the plurality of arms 19 and transferring the heat further to the cooling agent flowing through cooling passages 13. A material with good thermal conductivity such as copper would normally be used at least for arms 19.

Figure 4:
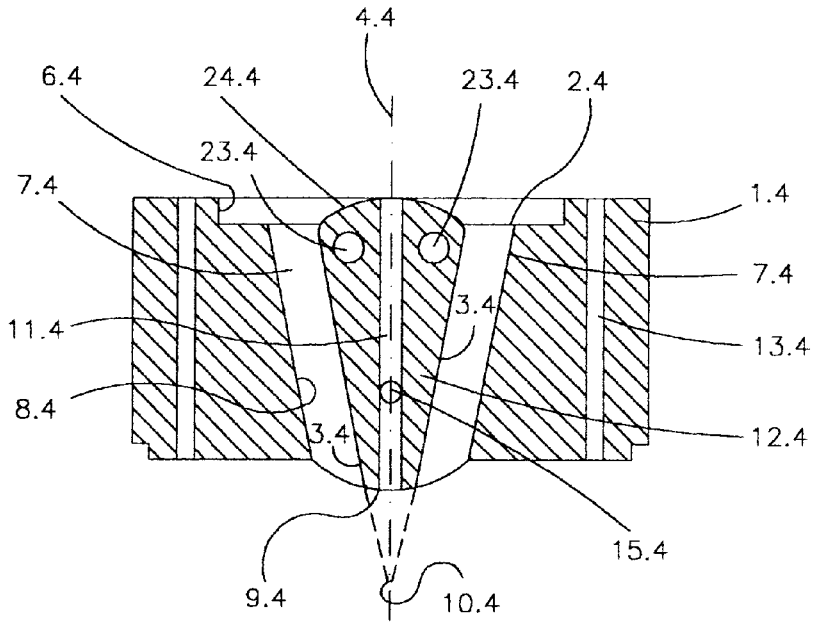
FIG. 4 is a schematic front elevation of the feedstock injector of the present invention, in cross-section, showing an alternate embodiment of the core wherein the feedstock input passage extends axially from the upstream end of the core to the tip of the core.
Figure 5:
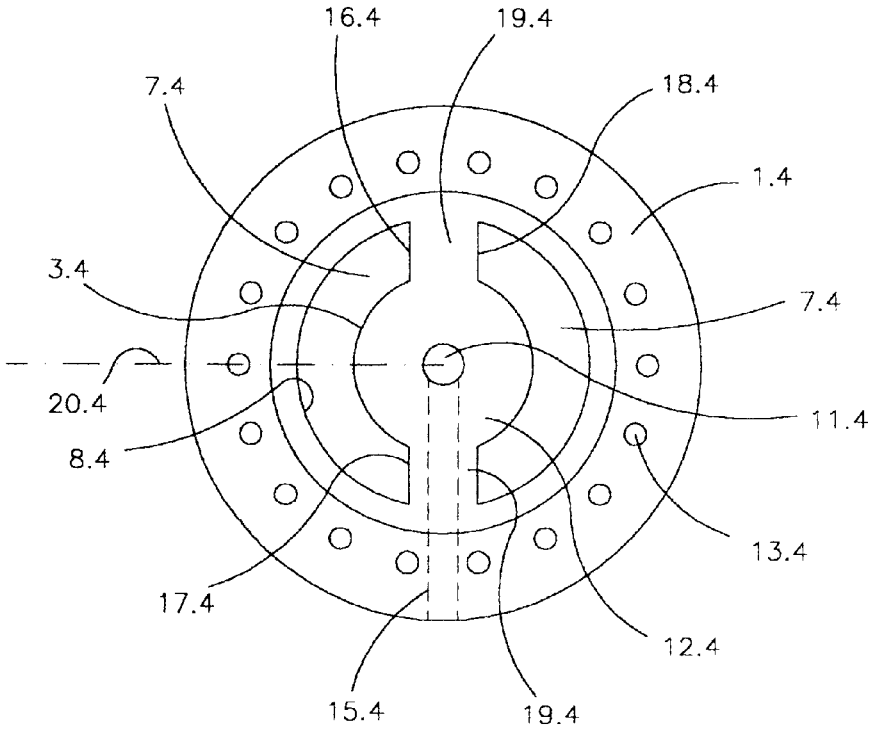
FIG. 5 is a plan view of the feedstock injector shown in FIG. 4.

Referring now to FIG. 4 and FIG. 5 of the drawings, an alternate embodiment of the core is shown. The numerical references in FIG. 4 and FIG. 5 include designation "0.4" and it should be understood that those references correspond to corresponding designated numerical references assigned in FIG. 1A, FIG. 1B, FIG. 2 and FIG. 3 and described above, except as may be modified in this paragraph. Instead of a plurality of minor channels, a single minor channel 11.4 is now provided extending from the upstream surface 24.4 of core 12.4 to the downstream core tip 9.4. The minor portion of the gas stream, such as the portion of the stream flowing about axis 4.4 will be directed into and will flow along channel 11.4. The major portion of the gas stream will be split by the inlet ends 2.4 of the major channels 7.4 and will flow through the plurality of major channels 7.4 converging towards the major region of convergence 10.4. The ratio of the cross-sectional area of the minor channel 11.4 and the total cross-sectional area of the plurality of major channels 7.4 is smaller than 1 to 1 and is preferably smaller than 1 to 20. The optimal ratio will be determined experimentally on a case by case basis, depending on the properties of the feedstock used.

Figure 6A:
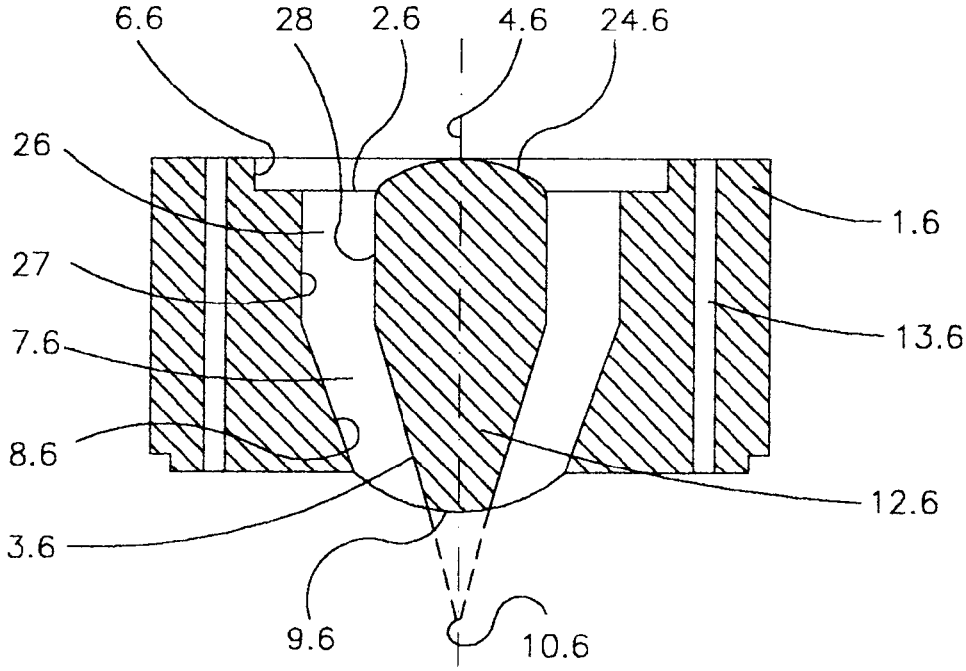
FIG. 6A is a schematic front elevation view of the feedstock injector of the present invention, in cross-section, showing an alternate embodiment of the major channel.
Figure 6B:
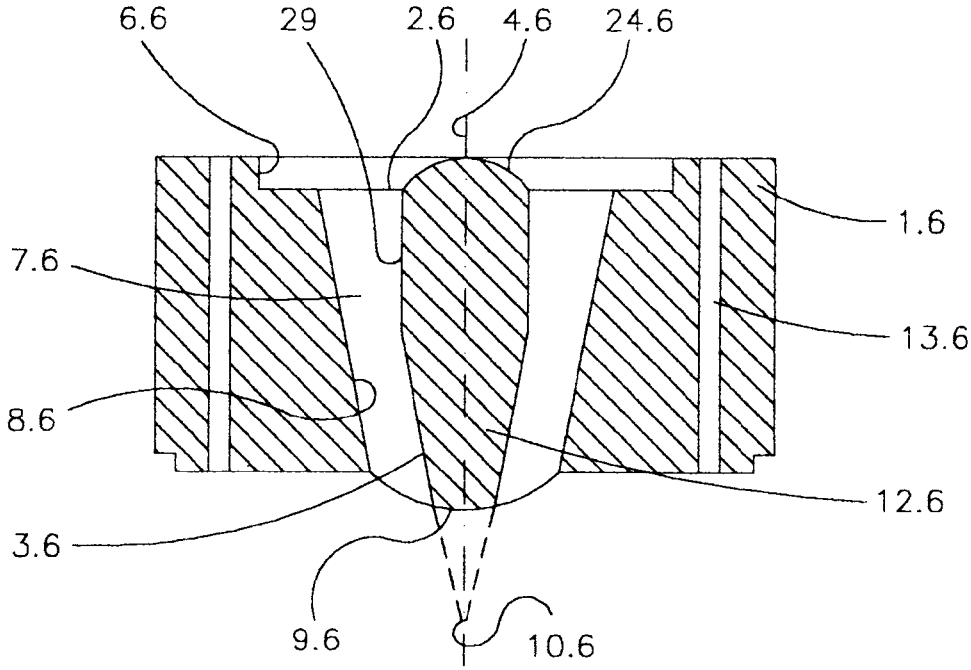
FIG. 6B is a schematic front elevation view of the feedstock injector of the present invention, in cross-section, showing an alternate embodiment of the inner wall of the major channel.

Referring now to FIG. 6A and FIG. 6B of the drawings, two alternate embodiments of the major channels are shown. For simplicity purposes the internal details of the core are not shown and it should be understood that the core may comprise any of the embodiments described above and with reference to FIG. 1A, FIG. 1B, FIG. 2, FIG. 3, FIG. 4 and FIG. 5. The numerical references in FIG. 6A and FIG. 6B include the designation "0.6" and it should be understood that those references correspond to corresponding designated numerical references assigned in FIG. 1A, FIG. 1B, FIG. 2, FIG. 3, FIG. 4 and FIG. 5, and described above, except as may be modified in this paragraph.

FIG. 6A shows the major channels now comprising an upstream non-converging section 26 merging with a downstream converging section 7.6. Section 26 comprises non-converging inner and outer path defining surfaces or walls 28 and 27 respectively, which are shown concentric about axis 4.6 and parallel with axis 4.6. At their downstream ends, nonconverging inner and outer walls 28 and 27 merge with corresponding converging inner and outer walls 3.6 and 8.6. Walls 28 and 3.6 substantially define core 12.6.

FIG. 6B shows the inner wall of the major channels 7.6 now comprising an upstream non-converging path defining surface or wall 29 merging with the downstream converging inner wall 3.6. Walls 29 and 3.6 substantially define core 12.6

If increased cooling of the core is desired, additional cooling provisions may be provided in any suitable fashion. In FIG. 2 for example, cooling channel 23 is shown passing through the upstream portion of an opposite pair of arms 19 and across the upstream portion of core 12. In FIG. 4, cooling channels 23.4 are shown schematically as flanking or going about channel 11.4. Generally, all surface edges and corners exposed to the gas flow should be rounded and designed aerodynamically, in order to minimize the disturbance of the gas flow.

The functioning principle of the injector comprising the first embodiment of the core will now be described with reference to FIG. 1A, FIG. 1B, FIG. 2 and FIG. 3. A source of hot gas such as a plasmatron or a fuel combustion chamber can be connected to the upstream surface of injector 1, for example by means of cavity 6. The gas stream discharged by the plasmatron or by the fuel combustion chamber is split by openings 2 into a plurality of major streams flowing through the plurality of major channels 7 arranged symmetrically about core 12. A minor portion of the streams traveling through channels 7 is diverted into a plurality of minor streams traveling through the minor channels 5 located inside core 12. Channels 5 direct the minor streams towards a converging region 14 located inside the core where the streams join each other and continue to flow as a single stream along feedstock-input passage 11. The remaining portion of the major streams continue to flow through major channels 7 and join each other in or about a region of convergence 10, thereby forming a single stream flowing downstream about axis 4. Feedstock material from an external source (not shown) is carried by means of a feedstock carrier gas through at least one feedstock-supply passages 15, which open into feedstock-input passage 11. Upon being discharged in passage 11, the feedstock is entrained by the minor portion of the gas stream flowing along passage 11. The feedstock is propelled forward along passage 11 by the combined flows of the carrier gas and the minor portion of the gas stream. Subsequently, the feedstock and the minor portion of the gas are injected axially towards the downstream region of convergence 10, therefrom becoming entrained axially by the major portion of the gas stream converged from the plurality of major channels 7. If desired, the carrier gas flow used to carry feedstock from an outside source into the injector can be reduced to the minimum necessary because the minor portion of the gas stream flowing along passage 11 will act effectively as a feedstock carrier gas, propelling the feedstock efficiently in an axial direction.

The functioning principle of the injector comprising the alternate embodiment of the core will now be described with reference to FIG. 4. The functioning is in many respects similar to the one described above and only the differences related to the alternate embodiment of the core will be described. A minor portion of the gas stream discharged by a plasmatron or by a fuel combustion chamber, such as the minor portion of the stream flowing about axis 4.4 is directed to flow along feedstock input passage 11.4. The remaining major portion of the gas stream is split by inlet ends 2.4 into a plurality of major streams flowing through the plurality of major channels 7.4 and converging towards the major region of convergence 10.4.

Figure 1B:
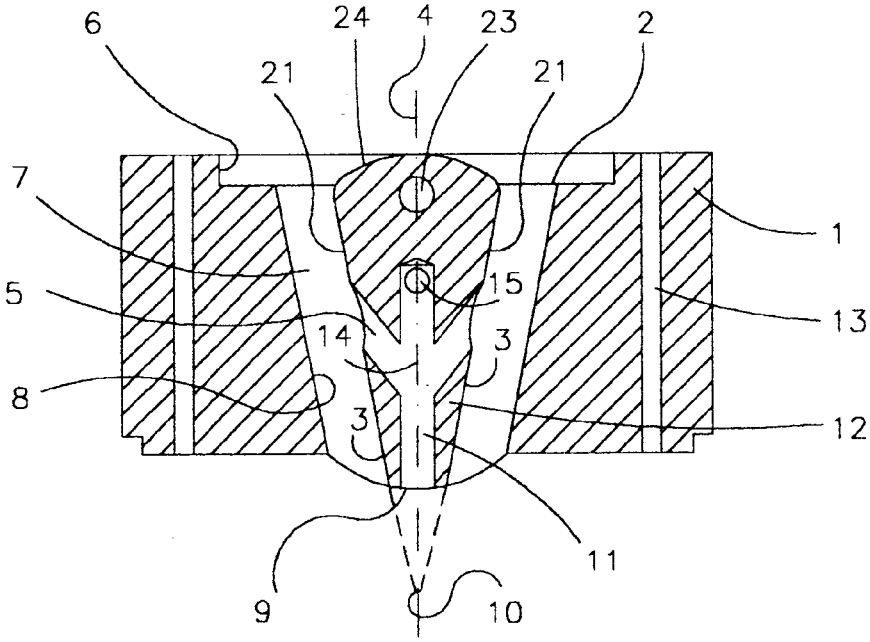
FIG. 1B is a schematic front elevation view of the feedstock injector of the present invention, in cross-section showing the first embodiment of the core but having the feedstock supply passage opening located upstream of the minor region of convergence of the minor channels

Consequently, the present invention provides for the injection of the feedstock in two consecutive steps. The feedstock is injected first into a minor portion of the gas, the first injection being either in a radial direction to the flow of the minor portion of the gas as shown in FIG. 1A and FIG. 4 or alternatively, the first injection being axially into the minor portion of the gas flow as shown in FIG. 1B. The first injection of the feedstock is subsequently followed by a second injection of the feedstock mixed with the minor portion of the gas stream, the second injection being axially into the major portion of the gas stream. Spray output nozzles may be further attached at the downstream end of injector 1 to assist in mixing the streams and to increase gas and feedstock velocity. One other advantage of the feedstock injection provided by the present invention is that the optimized axial injection results in optimized feedstock trajectory in an axial direction, therefore minimizing or eliminating feedstock build-up on the nozzle wall. This allows the use of longer output nozzles if desired. The improved heat and momentum transfer to the feedstock results in the provision of improved thermally sprayed coatings.

Figure 7:
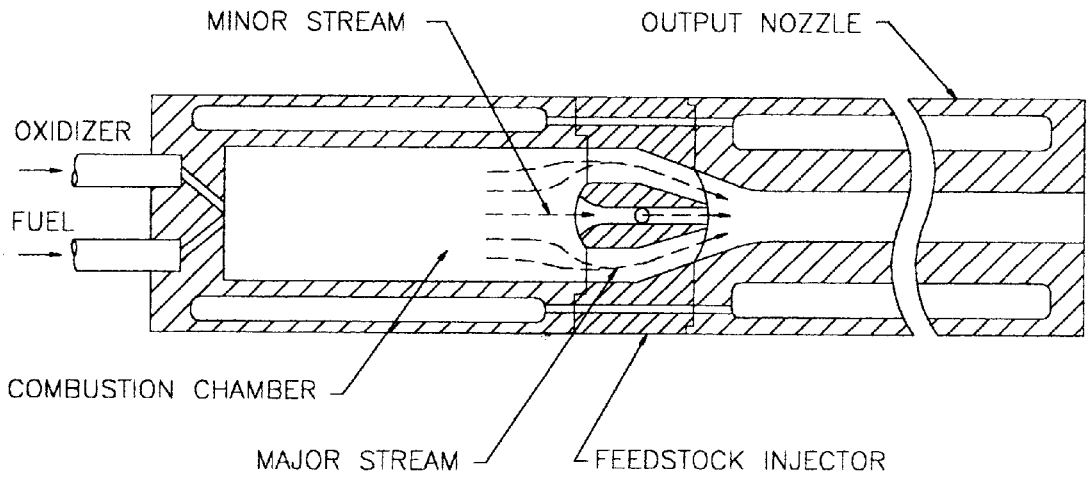
FIG. 7 is a schematic showing the feedstock injector of the present invention incorporated into a combustion flame spray apparatus.
Figure 8:
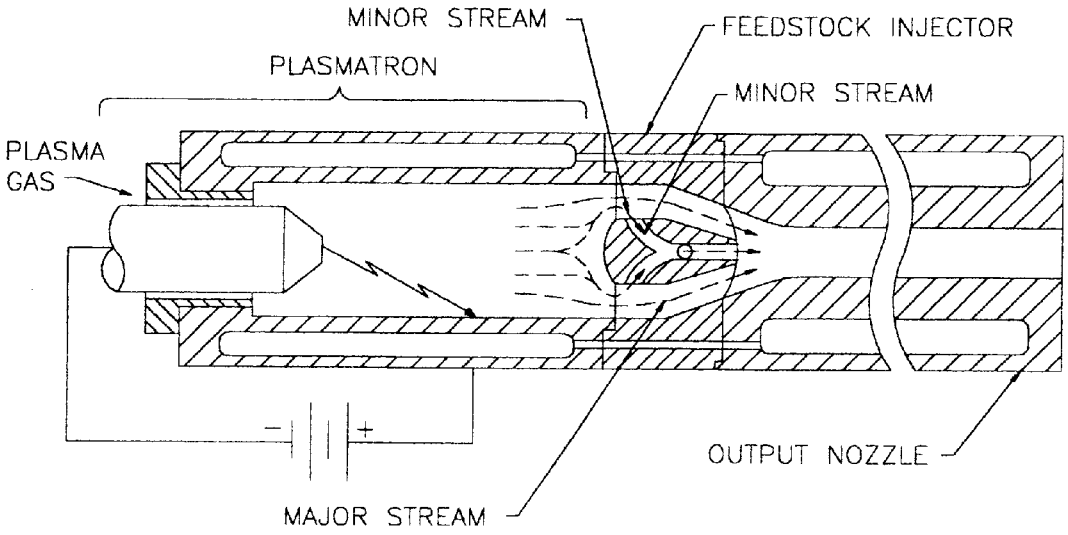
FIG. 8 is a schematic showing the feedstock injector of the present invention incorporated in a plasma spray apparatus.

Examples of practical use of the feedstock injector of the present invention are shown schematically in FIG. 7 and FIG. 8.

FIG. 7 shows one instance of the feedstock injector of the present invention schematically incorporated into a combustion spray torch. A combustion chamber is attached to the upstream end of the injector. At least one combustion fuel and one oxidizer such as air or oxygen are fed continuously at the upstream end the combustion chamber and the mixture is ignited immediately. The hot gas stream resulted from combustion flows in the direction of the upstream end of the feedstock injector and is split by the injector into a plurality of major streams and into a minor stream. The plurality of major streams flow about the core while the minor stream flows axially through the core where it entrains the feedstock and propels it forward along the feedstock input passage. An output spray nozzle is shown attached schematically to the downstream end of the injector. The output nozzle has its inlet shaped to receive the major streams and the feedstock propelled by the minor stream. Consequently, the feedstock travels substantially axially along the output spray nozzle.

FIG. 8 shows one instance of the feedstock injector of the present invention schematically incorporated into a plasma spray torch. A plasma generator, such as a plasmatron is attached to the upstream end of the injector. A gas flowing through the plasmatron arc chamber is heated into a plasma stream by the electric arc struck between a cathode and an anode. The plasma stream is discharged by the plasmatron at the upstream end of the feedstock injector and is split by the injector into a plurality of major streams flowing about the core. A plurality of minor streams are extracted from the plurality of major streams and are converged through the core into the upstream end of the feedstock-input passage. The plurality of minor streams merge into a single minor stream along the feedstock-input passage, the minor stream entraining the feedstock discharged from the feedstock supply passage and propelling it forward. An output spray nozzle is shown schematically attached to the downstream end of the feedstock injector. The output spray nozzle has its inlet shaped to receive the plurality of major streams and the feedstock propelled by the minor stream. Consequently, the feedstock travels substantially axially along the output spray nozzle.

Having described the embodiments of the invention, modifications will be evident to those skilled in the art without departing from the scope and spirit of the invention as defined in the following claims.

I claim:

1. A feedstock injector having a longitudinal axis, and comprising:

(a) a plurality of major channels extending from the upstream end to the downstream end of the injector, the plurality of major channels arranged substantially symmetrical about the longitudinal axis and converging towards a major region of convergence at a downstream location, the major channels shaped at their inlet end to receive a stream and to split the stream into a plurality of streams, each major channel having an inner wall, the plurality of inner walls substantially defining a core therebetween;

(b) a feedstock input passage located inside the core and oriented to direct feedstock axially towards the major region of convergence;

(d) a feedstock-supply passages opening into the feedstock input passage; and (e) a plurality of minor channels located inside the core, the minor channels arranged substantially symmetrical about the longitudinal axis, each minor channel extending from the inner wall of a major channel towards a minor region of convergence located inside the core and connected to the feedstock input passage, the total cross-sectional area of the plurality of minor channels being smaller than the total cross-sectional area of the plurality of major channels.

2. A feedstock injector as described in claim 1 wherein the ratio between the total cross-sectional area of the plurality of minor channels and the total cross-sectional area of the plurality of major channels is less than 1 to 20.

3. A feedstock injector as described in claim 2 wherein each major channel comprises an upstream section having non-converging inner and outer walls.

4. A feedstock injector as described in claim 2 wherein each inner wall comprises an upstream non-converging path defining surface.

5. A feedstock injector as described in claim 1 wherein each major channel comprises an upstream section having non-converging inner and outer walls.

6. A feedstock injector as described in claim 1 wherein each inner wall comprises an upstream non-converging path defining surface.

7. A feedstock injector having a longitudinal axis and comprising:

(a) a plurality of major channels extending from the upstream end to the downstream end of the injector, the plurality of major channels arranged substantially symmetrical about the longitudinal axis and converging towards a major region of convergence at a downstream location, the major channels shaped at their inlet end to receive a major portion of a stream and to split the major portion into a plurality of major streams, each major channel having an inner wall, the plurality of inner walls substantially defining a core therebetween;

(b) a minor channel extending axially from the upstream end to the downstream end of the core, the inlet end of the minor channel shaped to receive the minor portion of the stream, the cross-sectional area of the minor channel being smaller than the total cross-sectional area of the plurality of major channels; and (c) a feedstock-supply passages opening into the minor channel.

8. A feedstock injector as described in claim 7 wherein the ratio between the cross-sectional area of the minor channel and the total cross-sectional area of the plurality of major channels is less than 1 to 20.

9. A feedstock injector as described in claim 8 wherein each major channel comprises an upstream section having non-converging inner and outer walls.

10. A feedstock injector as described in claim 8 wherein each inner wall comprises an upstream non-converging path defining surface.

11. A feedstock injector as described in claim 7 wherein each major channel comprises an upstream section having non-converging inner an outer walls.

12. A feedstock injector as described in claim 7 wherein each inner wall comprises an upstream non-converging path defining surface.

* * * * *